US011377801B2

(12) United States Patent
Easter

(10) Patent No.: US 11,377,801 B2
(45) Date of Patent: Jul. 5, 2022

(54) RESILIENT DECK STRUCTURE

(71) Applicant: Edward H. Easter, Cockeysville, MD (US)

(72) Inventor: Edward H. Easter, Cockeysville, MD (US)

( * ) Notice: Subject to any disclaimer, the term of this patent is extended or adjusted under 35 U.S.C. 154(b) by 0 days.

(21) Appl. No.: 17/086,668

(22) Filed: Nov. 2, 2020

(65) Prior Publication Data

US 2021/0047789 A1 Feb. 18, 2021

Related U.S. Application Data

(63) Continuation-in-part of application No. 16/516,306, filed on Jul. 19, 2019, now Pat. No. 10,822,750.

(60) Provisional application No. 62/703,981, filed on Jul. 27, 2018.

(51) Int. Cl.

| | |
|---|---|
| ***E01C 13/04*** | (2006.01) |
| ***E01C 13/02*** | (2006.01) |
| *A63B 102/08* | (2015.01) |

(52) U.S. Cl.

CPC ..... *E01C 13/04* (2013.01); *E01C 13/02* (2013.01); *A63B 2102/08* (2015.10)

(58) Field of Classification Search

CPC ..... E01C 13/02; E01C 13/04; E01C 13/08; E01C 13/10; A63C 19/00; A63C 2203/20; E04B 5/10

USPC ..... 472/92–94; 52/167.7, 167.8; 473/415, 473/490

See application file for complete search history.

(56) References Cited

U.S. PATENT DOCUMENTS

| | | | |
|---|---|---|---|
| 1,900,721 | A | 3/1933 | Manske et al. |
| 3,067,843 | A | 12/1962 | Rushtoh et al. |
| 3,302,361 | A | 2/1967 | Oudheusden, Jr. et al. |

(Continued)

FOREIGN PATENT DOCUMENTS

| | | |
|---|---|---|
| EP | 1 611 930 A1 | 1/2006 |
| WO | 86/05228 A1 | 9/1986 |

OTHER PUBLICATIONS

Leśniak et al., "Technical Transactions: Selection of a Sports Flooring Type," Wybór Wariantu Wykonania Podłogi Sportowej, 2015, pp. 185-190.

(Continued)

*Primary Examiner* — Kien T Nguyen

(74) *Attorney, Agent, or Firm* — Gibb & Riley, LLC

(57) ABSTRACT

A resilient platform assembly has a playing deck with horizontally disposed deck panels. Each deck panel has a pair of foot flanges on the bottom of the deck panels. Receiving shoes are attached to the deck panels and configured to receive the foot flanges of the deck panels. A transverse member, perpendicular to the horizontally disposed deck panels, includes a plurality of notches. Each notch is cut in the transverse member in a predetermined spacing pattern. The receiving shoes are installed in the notches and the deck panels are attached to the transverse member through the receiving shoes. Resilient mounts connect the transverse member to a support assembly and allow relative motion between the transverse member and the support assembly. The resilient mounts include a first spring capture assembly attached to the support assembly, a second spring capture assembly attached to the transverse members, and a plurality of springs disposed between the first spring capture assembly and the second spring capture assembly.

19 Claims, 7 Drawing Sheets

(56) References Cited

U.S. PATENT DOCUMENTS

| | | | | |
|---|---|---|---|---|
| 3,383,108 | A | 5/1968 | Reilly, Jr. | |
| 3,904,193 | A | 9/1975 | Patterson | |
| 3,935,687 | A | 2/1976 | Vaughn et al. | |
| 3,951,406 | A | 4/1976 | Rock | |
| 4,146,221 | A | 3/1979 | Newquist et al. | |
| 4,198,042 | A | 4/1980 | Olson | |
| 4,648,592 | A | 3/1987 | Harinishi | |
| 5,277,010 | A | 1/1994 | Stephenson et al. | |
| 5,617,689 | A | 4/1997 | Beane | |
| 6,256,958 | B1 | 7/2001 | Matthews | |
| 6,324,795 | B1 | 12/2001 | Stiles et al. | |
| 6,488,600 | B1 | 12/2002 | Gordon | |
| 6,651,398 | B2 | 11/2003 | Gregori | |
| 6,682,444 | B2 | 1/2004 | Gordon | |
| 6,755,001 | B2 | 6/2004 | Eaton | |
| 7,849,646 | B2 | 12/2010 | Harinishi | |
| 8,661,754 | B2 | 3/2014 | Hsu et al. | |
| 2011/0263343 | A1* | 10/2011 | Weller | A63B 5/08 472/92 |

OTHER PUBLICATIONS

U.S. Appl. No. 16/516,306, EAS5000, Office Action Communication dated Mar. 27, 2020, pp. 1-7.
U.S. Appl. No. 16/516,306, EAS5000, Notice of Allowance dated Jul. 10, 2020, pp. 1-5.

* cited by examiner

RESILIENT DECK STRUCTURE

CROSS-REFERENCE TO RELATED APPLICATIONS

This application claims the benefit under 35 U.S.C. § 120 as a Continuation-in-Part of U.S. patent application Ser. No. 16/516,306 filed Jul. 19, 2019, which claims priority to U.S. Provisional Application Ser. No. 62/703,981 filed Jul. 27, 2018, the complete disclosures of which are incorporated herein by reference, in their entirety.

BACKGROUND

This disclosure relates to new and useful improvements in deck structures and particularly the construction of platform tennis courts having a resilient deck structure.

Platform tennis or paddle tennis, as it is commonly referred to, is played on a raised platform having screened sidewalls and endwalls. The game is played in much the same way as conventional tennis, except that in the game of paddle tennis, the ball may be played off the screened endwalls and sidewalls. The playing surface or deck of the paddle tennis court must provide a flat surface and, at the same time, permit easy maintenance and repair.

Paddle tennis has developed over the years as a popular out-of-doors, all-season sport. Due to variable weather conditions, particularly in winter, the raised platform of the paddle tennis court is constructed to allow for water drainage and to permit the easy removal of snow and ice. Originally, platform tennis courts were made with painted wood. Commonly, thick, 2×6 lumber was used for the decking with walnut chips cast in the paint on the playing surface to provide better footing. In the early 1970's, aluminum decks were developed to counter the durability problems and warpage problems of wood. The aluminum extrusions used for the playing surface soon copied the basic shape of the original wooden decks using evenly spaced reinforcing ribs on the bottom for rigidity. This basic extrusion shape is still the standard of platform tennis court manufacturers to this day.

A 30-foot long extrusion is too long to support much load on its own. Consequently, on today's platform tennis courts, I-beams are used to span the width of the court to support the extruded decking. Six or seven I-beams may be used, supported by three or more concrete piers per I-beam. Typically, groups of deck extrusions are welded together to an underneath metal structure in both directions for more strength. This type of boxed reinforcement requires careful alignment and extensive welding. Hence, this fabrication is normally done at a remote facility, not at the court site. Normally, several modules approximately 5-feet wide and 30-feet long are formed from extrusions welded to such boxed channel structure underneath. Each module may weigh upwards of 400 lbs., which is as much mass/bulk as can be comfortably handled by an assembly crew on site. While the resulting deck of a platform tennis court today usually weighs less than a wooden deck, the welding is extensive, requiring what one industry source quoted as over 14,000 welds.

While aluminum has solved nearly all of the limitations of wood, there are complaints from many players based on the court being too rigid and unforgiving on knees and other joints due to the hardness of the aluminum. Additionally, the grit-based coating used to allow proper footing in wet or snowy conditions in which the sport can be played tends to lock the players' feet in place more than desired, causing additional injury.

SUMMARY

Various embodiments herein suspend the aluminum platform deck on a resilient base, lessening impacts on the body from the typical movement on the court and reducing the chance for injuries related to impact transferred through the feet. Springs or other resilient members can be used to establish and adjust the firmness of the playing surface.

In addition, some embodiments use a modular approach to construction of the resilient deck. Taller (deeper) and wider deck panel extrusions can be used to virtually eliminate the need for welded reinforcement. The deck panel extrusions described herein can be mechanically fastened together, using cross-tie assemblies with geometry matched to the feet of the extrusions. Individual deck extrusions are dropped in place over the cross-tie channels with the tapered feet of the extrusions aligning in the V-shaped shoe of the cross-tie assemblies. Aligned holes in the extrusion feet and cross-tie channel assemblies ensure a goof-proof bolted connection with minimal effort. The net result is that most welding is eliminated, such that the deck panel extrusions can be sent directly from the extruder to the job site and handled individually, creating substantial overall savings.

According to a structure herein, a playing deck includes a plurality of horizontally disposed deck panels. A support assembly is connected to the horizontally disposed deck panels. Resilient mounts connect the horizontally disposed deck panels to the support assembly. The resilient mounts are flexible and allow relative motion between the horizontally disposed deck panels and the support assembly. The resilient mounts include a first spring capture assembly attached to the support assembly, a second spring capture assembly attached to the playing deck, and a plurality of springs disposed between the first spring capture assembly and the second spring capture assembly.

According to a resilient platform assembly, a playing deck includes a plurality of horizontally disposed deck panels. Each deck panel of the plurality of horizontally disposed deck panels has a pair of foot flanges that mate with the receiving shoes of transverse members. The transverse members are perpendicular to the plurality of horizontally disposed deck panels. Each transverse member includes a plurality of notches. Each notch of the plurality of notches is in a spacing pattern along the span of the transverse member. The receiving shoes are in the notches. Resilient mounts are connected to the transverse member. A support assembly is connected to the resilient mounts. The resilient mounts include a first spring capture assembly attached to the support assembly, a second spring capture assembly attached to the transverse members, and a plurality of springs disposed between the first spring capture assembly and the second spring capture assembly.

A platform assembly herein comprises a supporting substructure including a plurality of piers configured to be anchored in the ground, and a plurality of I-beams on the piers. Each of the I-beams has a top surface at a predefined distance above the ground. Transverse members are arranged in a spaced apart layout parallel to the I-beams. The transverse members have a bottom surface above the top surface of the I-beams relative to the ground. Each transverse member has a plurality of notches in a spacing pattern along the span of its length aligned with the feet of extruded deck panels. A mounting assembly is resiliently connected between the supporting substructure and the transverse members. The mounting assembly includes a first spring capture assembly attached to the supporting substructure, a second spring capture assembly attached to the transverse members, and a plurality of springs disposed between the first spring capture assembly and the second spring capture assembly.

BRIEF DESCRIPTION OF THE DRAWINGS

The structures and methods herein will be better understood from the following detailed description with reference to the drawings, which are not necessarily drawn to scale and in which.

DETAILED DESCRIPTION

Figure 1:
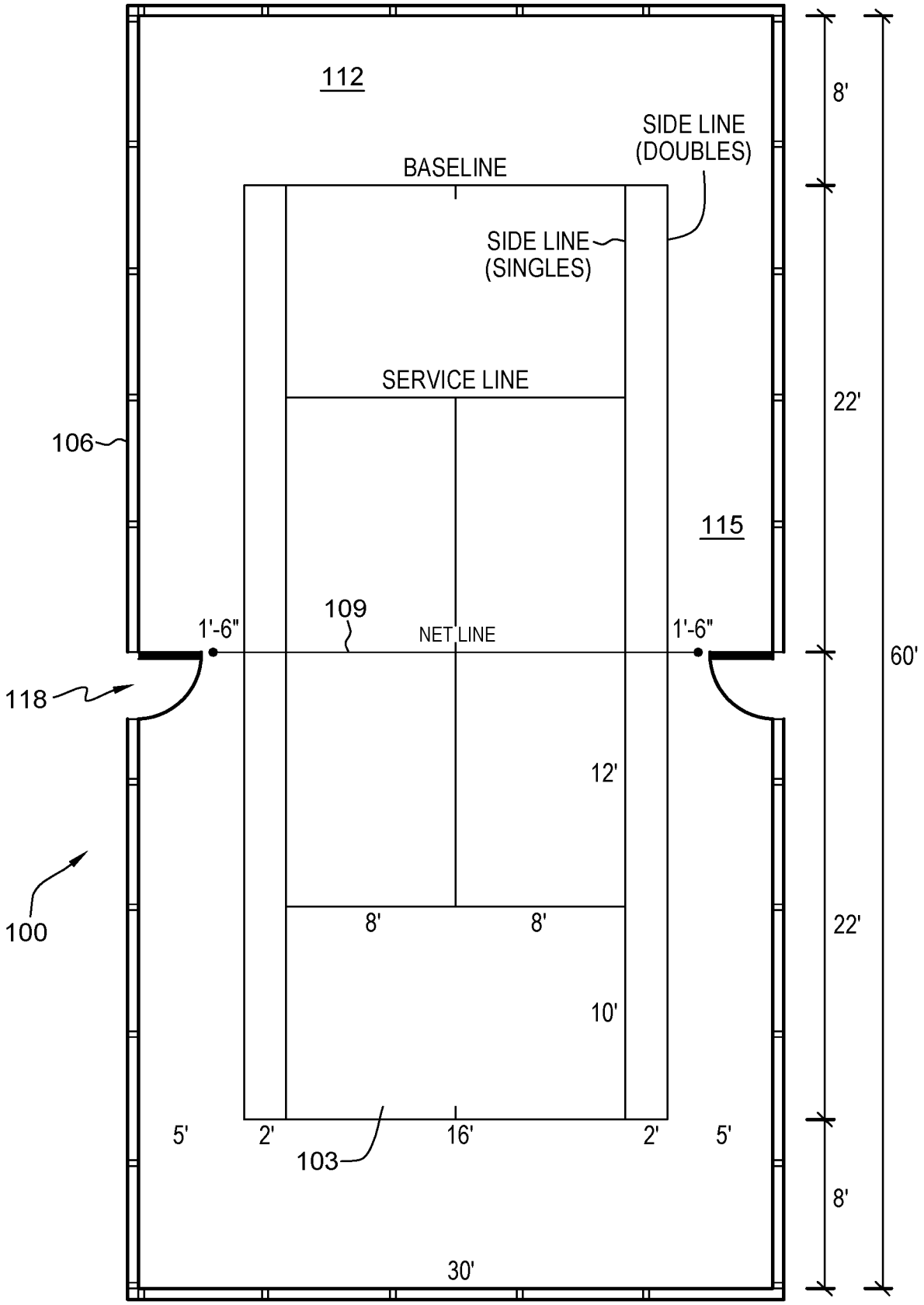
FIG. 1 is a plan view of an exemplary paddle tennis court showing dimensions.

The exemplary deck assembly structure disclosed herein increases the rigidity of the deck extrusions by increasing the depth of the deck extrusions, which allows the elimination of welded box reinforcement channel underneath the deck extrusions. By using channel shapes which can be, in one example, approximately 4-inches deep and having a thicker construction, such as the surface being approximately 0.16-inch thick, the resulting 30-foot extrusion can be orders of magnitude stronger than the extrusions currently used for a platform tennis deck. Additionally, by bolting the legs of adjacent deck extrusions together with a spacer (in one example, nominal 1" thick as drawn) the entire structure will become even more rigid. In fact, it would be possible to reduce the wall thickness of the deck extrusions while maintaining sufficient rigidity of the structure by increasing the number of connection points of the legs of adjacent deck extrusions.

The entire deck assembly is floating on springs (or appropriate flexible/resilient devices) mounted on an assembly that straddles supporting I-beams with a height-adjustable hanger mount for each spring on each side of the I-beam. Spring pairs are used to support the deck extrusions with a connection to a common top plate through a notched cross-tie channel. This assembly may be bolted or otherwise attached to the top flange of the I-beam. As illustrated in the drawings, a pinch mount using long bolts allow channels to clamp the spring assemblies to the I-beam, enabling easy repositioning of the assembly, as needed. Other resilient mounts can be used, such as rubber sheets or bushings, air cushions, gas pistons, arched elements, and the like, as would be known by one skilled in the art.

The springs may be retained by bolt-on plastic or polyurethane spring spools that capture the inside of the spring or other types of retainers, such as cups that capture the outside of the springs or clips that thread into the spring. Spring spools and springs are common on industrial vibratory mills, screeners, feeders, and packing tables.

The firmness of the playing deck may be controlled by the quantity of springs and the compression rating of the springs. This firmness can be altered by substituting springs with different compression ratings as well as by altering the number of springs used.

Referring now to the drawings, FIG. 1 shows one example of a paddle tennis platform deck, indicated generally as 100, with the dimensions of a paddle tennis court 103, according to the American Platform Tennis Association, illustrated thereon. The court 103 is a rectangle, and can be, for example, 44-feet long and 20-feet wide, laid out on the deck 100 with a playing area of 60-feet by 30-feet that is enclosed by a screen 106. The screen 106 can be 12-feet high and be held taut by a superstructure around the perimeter of the deck 100. The court 103 can be divided across the middle by a net 109. Lines can be provided to indicate the playing area on the court 103. There is an end space 112 of 8-feet between each baseline and the back of the screen 106 and a side space 115 of 5-feet between each sideline and the side of the screen 106. On either side of the court 103, or on both sides, an access door 118 can be cut into the superstructure. The door 118 can be located near the center of the screen 106 on the side.

Figure 2A:
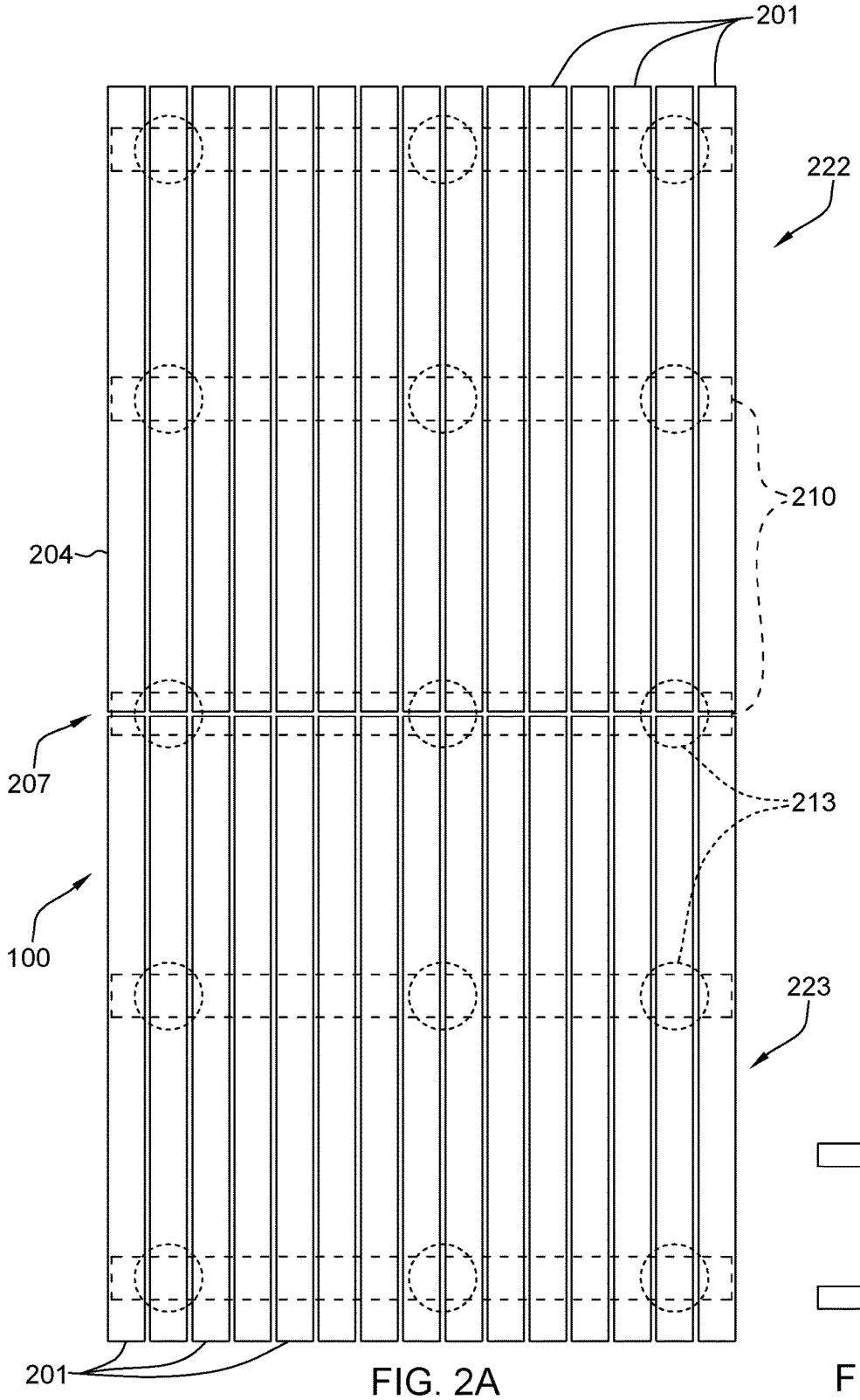
FIG. 2A is an exemplary illustration of a deck structure having support structures for deck panels according to structures and methods herein.
Figure 2B:
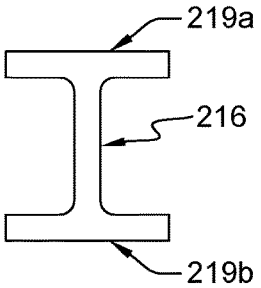
FIG. 2B is a cross-section view of an exemplary I-beam.

As shown in FIG. 2A, the deck 100 may include a plurality of deck panels 201 forming a platform assembly 204 mounted on a supporting substructure 207. Each deck panel 201, which is described in more detail below with reference to FIG. 3, may be parallel to an adjacent deck panel 201 and spaced apart a predetermined distance in the horizontal direction to form the platform assembly 204. The platform assembly 204 may be constructed of a plurality of deck panels 201 that are resiliently attached to transverse members, which are described in more detail below with reference to FIGS. 5 and 6. The supporting substructure 207 may include I-beams 210, which I-beams 210 may in turn be supported by piers 213, as shown in FIG. 2A. As would be known by one of ordinary skill in the art, an I-beam 210 is an elongate support structure used in construction, typically made of metal, with an I or H-shaped cross-section, as shown in FIG. 2B. The vertical element is known as the "web" 216, while the horizontal elements that expand outwardly from the web 216 are known as flanges. For convenience, the flanges are indicated as the top flange 219*a* and the bottom flange 219*b*. The web 216 resists shear forces, while the flanges 219*a* and 219*b* resist most of the bending moment experienced by the I-beam 210. In general, the I-shaped section is a very efficient form for carrying both bending and shear loads in the plane of the web 216. Several piers 213 may be arranged in a substantially rectangular arrangement having multiple I-beams 210 mounted in parallel over a number of piers 213. In this way, the platform assembly 204 may be supported above the ground to allow for water drainage and to permit the easy removal of snow and ice.

Figure 3A:
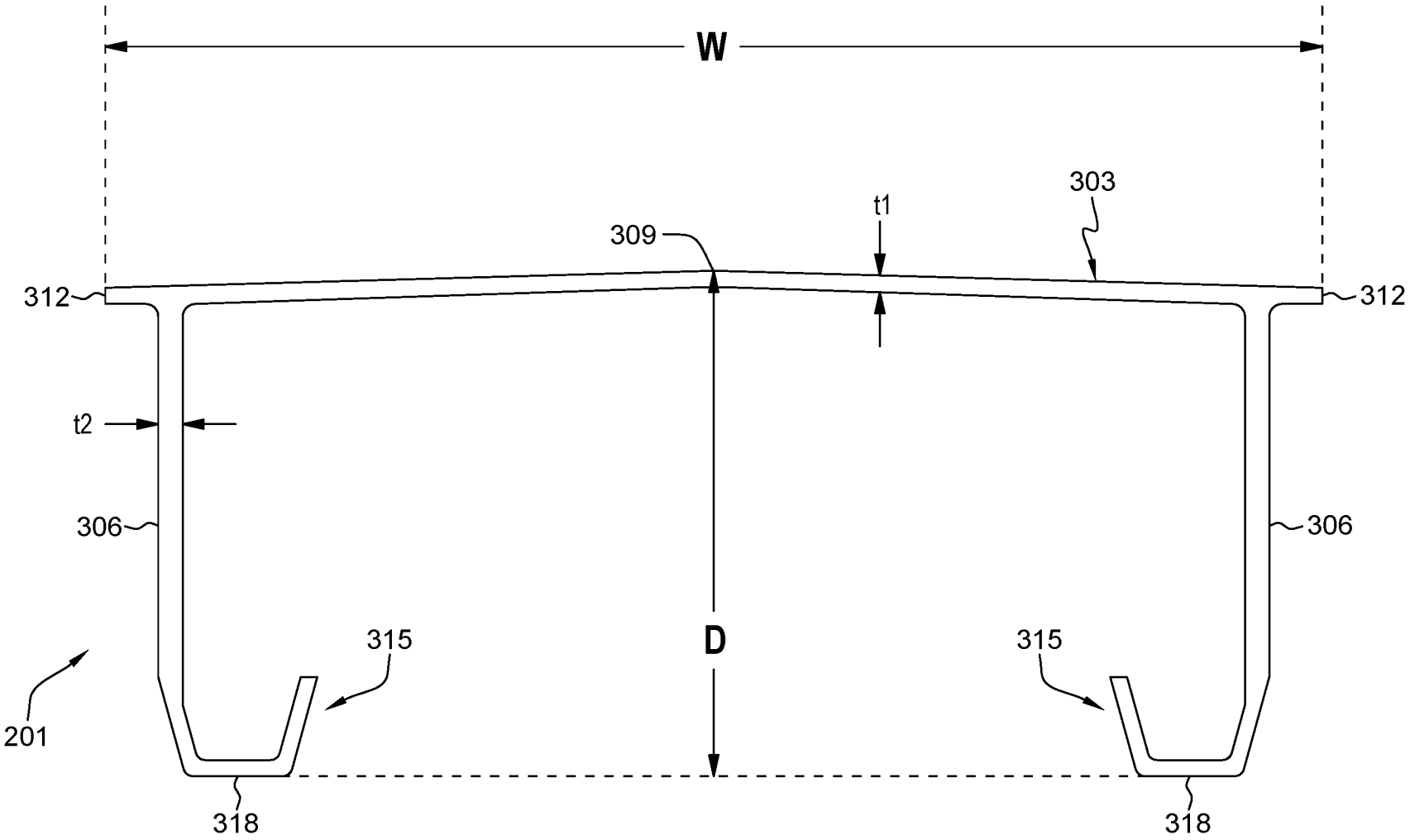
FIG. 3A is an end view of an exemplary deck panel according to structures and methods herein.
Figure 3B:
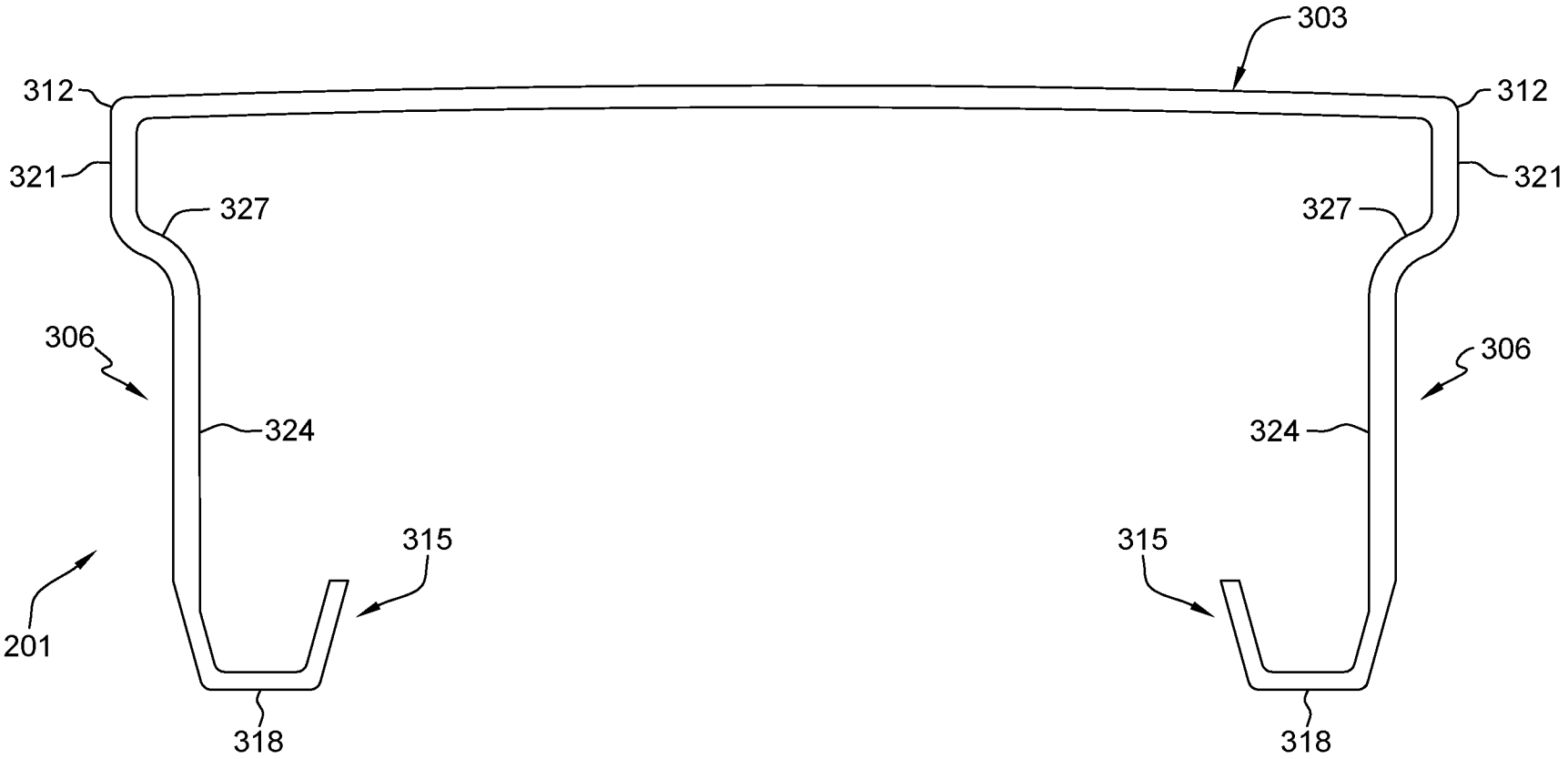
FIG. 3B is an end view of another exemplary deck panel according to structures and methods herein.

FIG. 3A shows an end view of an exemplary deck panel 201 according to structures and methods herein. Each deck panel 201 is typically made of a durable material, such as a metal, alloy, plastic, etc., and can be, in one example, extruded aluminum. Each deck panel 201 is substantially rectangular, 30-feet long. The deck panel 201 has a top plate 303 disposed laterally and integrally formed legs 306 disposed vertically. The legs 306 may be substantially (e.g., within 15%) perpendicular to the top plate 303. The top plate 303 may have a width W of, for example, approximately 11.6-inches and a thickness t1 of, for example, approximately 0.16-inches. In some embodiments, the top plate 303 may have a crowning peak such that the center 309 is approximately 0.125-inches higher than the edges 312. To achieve the crowning peak, a constant radius could be used. Each leg 306 may have a depth D of, for example, approximately 4.75-inches and a thickness t2 of, for example, approximately 0.20-inches. The legs 306 should be vertical and may be disposed inwardly, for example, approximately 0.5-inches from the edges 312 of the top plate 303. In some cases, such as shown in FIG. 3B, the legs 306 may start from the edges 312 of the top plate 303 and include a short vertical top section 321 that transitions into a long vertical bottom section 324 through a bend, such as 327. The legs 306 provide the deck panel 201 with resistance to bending in the vertical direction. The bottom of the legs 306 includes a foot flange 315 geometrically shaped to provide rigidity for resistance to bending in the horizontal direction. The foot flange 315 includes a bottom face 318 where the deck panel 201 is connected to the supporting assembly as described below. Each foot flange 315 extends away from its leg 306 toward the foot flange 315 on the opposite leg 306 of the deck panel 201. In other words, each foot flange 315 of a deck panel 201 extends inwardly, toward the center 309 of the deck panel 201 and away from the edges 312.

Referring again to FIG. 2, a plurality of deck panels 201 may be horizontally disposed in a predetermined rectangular configuration on the supporting substructure 207. According to structures and methods herein, thirty deck panels 201 may be used to form each of two adjacent sections 222, 223. As shown in FIG. 4, the supporting substructure 207 includes a plurality of piers 213 anchored in the ground in a spaced-apart, rectangular array with a plurality of I-beams 210 mounted on the piers 213. The I-beams 210 are supported by the piers 213. A plurality of I-beams 210 may be rigidly secured to and extending between the piers 213. Each I-beam 210 may span several piers 213 with adjacent I-beams 210 being in parallel. The deck panels 201 may be arranged perpendicular to the I-beams 210, spanning multiple adjacent parallel I-beams 210. Each deck panel 201 can be, for example, approximately 11.6-inches wide and 30-feet long and may be spaced apart with a gap G to make up each section 222, 223 of the deck 100. The gap G may be, for example, approximately 0.20-inches to approximately 0.25-inches wide. Other appropriate sizes for the gap G may be used. Two sections 222, 223 may be arranged end-to-end in the long direction of the deck panels, which will create the deck 100. The deck can be, for example, 30-feet wide and 60-feet long. The deck panels 201 may be connected to the I-beams 210 by a mounting assembly 404 resiliently connecting the deck panels 201 to the supporting substructure 207.

Figure 4A:
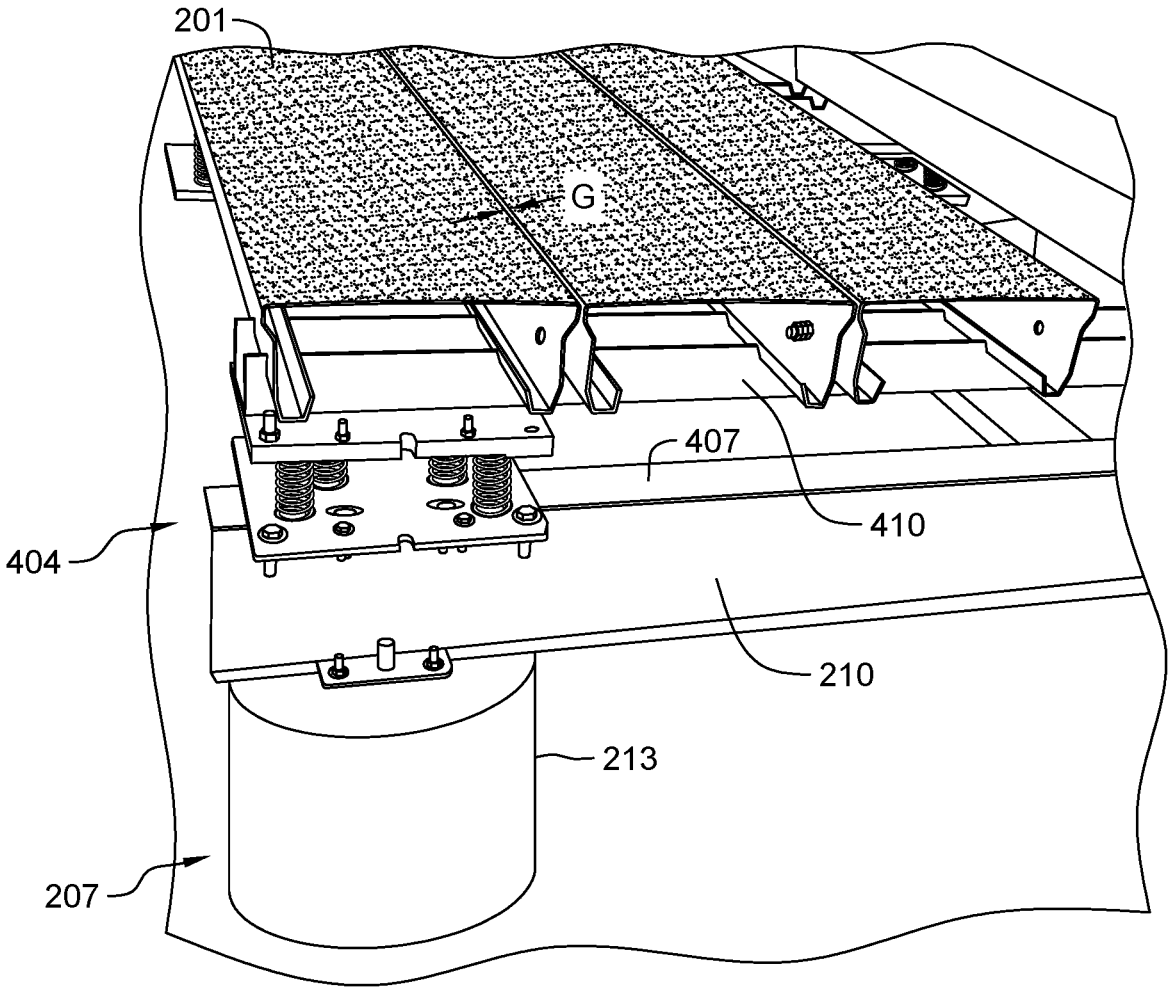
FIG. 4A shows an exemplary perspective view of a partially assembled deck structure according to structures and methods herein.
Figure 4B:
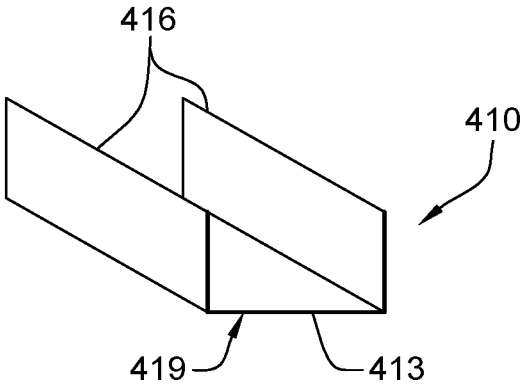
FIG. 4B is a cross-section view of an exemplary U-channel.

Referring to FIG. 4A, the top flange 219*a* of the I-beam 210 has a top surface 407 at a predefined distance above the ground. A transverse member 410 is arranged in a spaced apart layout parallel to the I-beam 210 and vertically aligned with the I-beam 210. In some embodiments, the transverse member 410 may be an elongated U-channel. As would be known by one of ordinary skill in the art, a U-channel is typically a structural track with a U-shaped cross-section, such as shown in FIG. 4B. The U-channel may be extruded metal or flat rolled and brake formed to have a flat bottom 413 and two vertical side flanges 416 sticking out from the same side of the flat bottom 413. The transverse member 410 has a bottom surface 419 that is positioned above the top surface 407 of the I-beam 210 relative to the ground. The mounting assembly 404 allows relative motion between the transverse member 410 and the I-beam 210.

Figure 5:
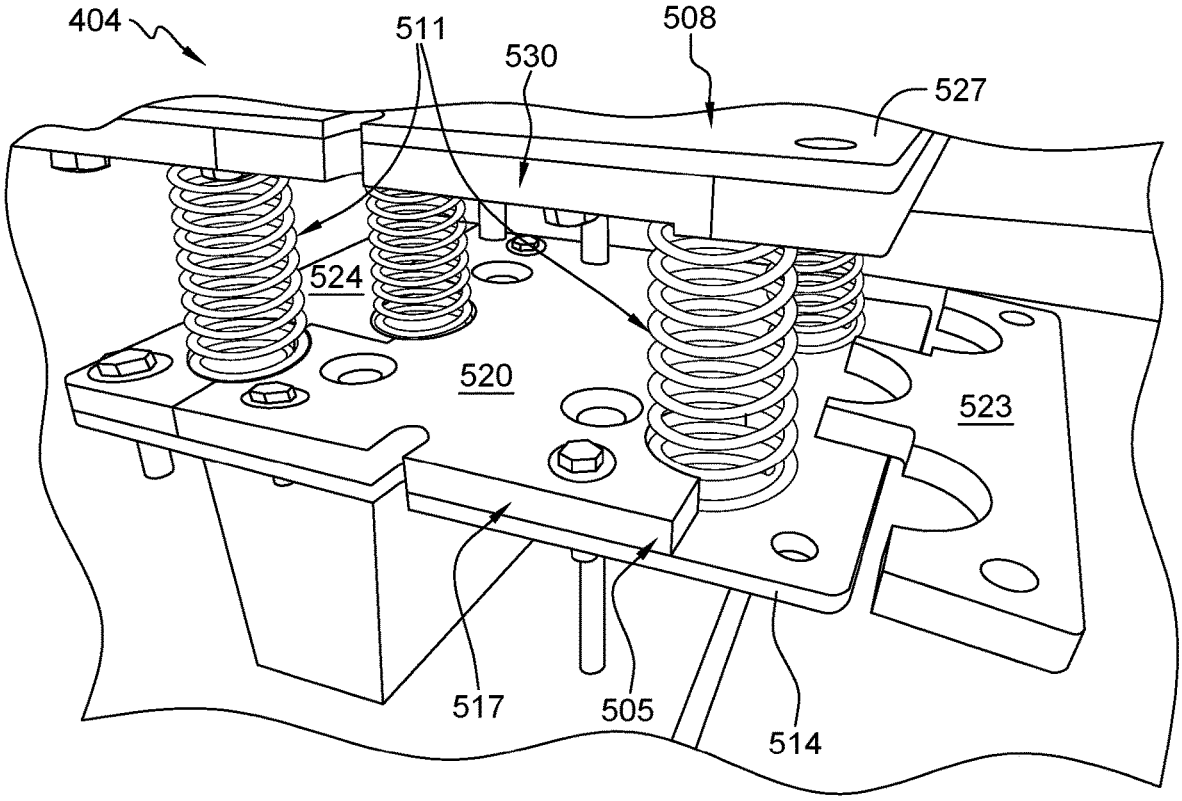
FIG. 5 shows an exemplary mounting assembly according to structures and methods herein.

FIG. 5 shows a mounting assembly 404 according to devices and methods herein. The mounting assembly 404 includes a first spring capture assembly 505 attached to the supporting substructure 207, a second spring capture assembly 508 attached to the transverse member 410, and a plurality of springs 511 disposed between the first spring capture assembly 505 and the second spring capture assembly 508. The first spring capture assembly 505 includes a bottom spring plate 514 attached to the top surface 407 of the I-beam 210. The bottom spring plate 514 can be mounted to the top flange 219*a* of the I-beam 210 with no drilling and no welding. The first spring capture assembly 505 further includes bottom retention plates 517 attached to the bottom spring plate 514. Preferably, the bottom retention plates 517 are bolted to the bottom spring plate 514. Other methods may be used. The bottom retention plates 517 may be made of High Density Poly Ethylene (HDPE) or other appropriate material to hold the outside of each spring of the plurality of springs 511. In some embodiments, the bottom retention plates 517 may be approximately ½-inch thick. As shown in FIG. 5, the bottom retention plates 517 may be made of several pieces, such as a bottom center piece 520 bolted to the bottom spring plate 514 and bottom side pieces 523, 524. The second spring capture assembly 508 includes a top spring plate 527 attached to the bottom surface 419 of the transverse member 410. The top spring plate 527 can be mounted to the transverse member 410 with no drilling and no welding. The second spring capture assembly 508 further includes top retention plates 530 attached to the top spring plate 527. Preferably, the top retention plates 530 are bolted to the top spring plate 527. Other methods may be used. The top retention plates 530 may be made of High Density Poly Ethylene (HDPE) or other appropriate material to hold the outside of each spring of the plurality of springs 511. In some embodiments, the top retention plates 530 may be approximately ½-inch thick. Although not shown in FIG. 5, the top retention plates 530 may also be made of several pieces, similar to the bottom retention plates 517. In this manner, one or more springs of the plurality of springs 511 can be easily removed or added to the mounting assembly 404 by removing one or both of the side pieces, allowing a spring to slide into and out of the mounting assembly 404.

The mounting assembly 404 includes springs 511 connected on a first end to the first spring capture assembly 505 and connected on a second end to the second spring capture assembly 508. The springs 511 may be retained by the bottom retention plates 517 and the top retention plates 530 that capture the outside of the springs 511. According to devices and methods herein, the springs 511 may be mounted in pairs up to 6 springs per mounting assembly 404. The mounting assembly 404 maintains spacing between the bottom 413 of the transverse member 410 and the top surface 407 of the I-beam 210, allowing relative motion between the deck 100 and the I-beam 210. In this way, the deck 100 is floating on resilient mounts on top of several supporting I-beams 210. The firmness of the playing deck 100 may be controlled by the quantity and the compression rating of the springs 511. This firmness can be altered by substituting springs with different compression ratings as well as by altering the number of springs used.

Figure 6:
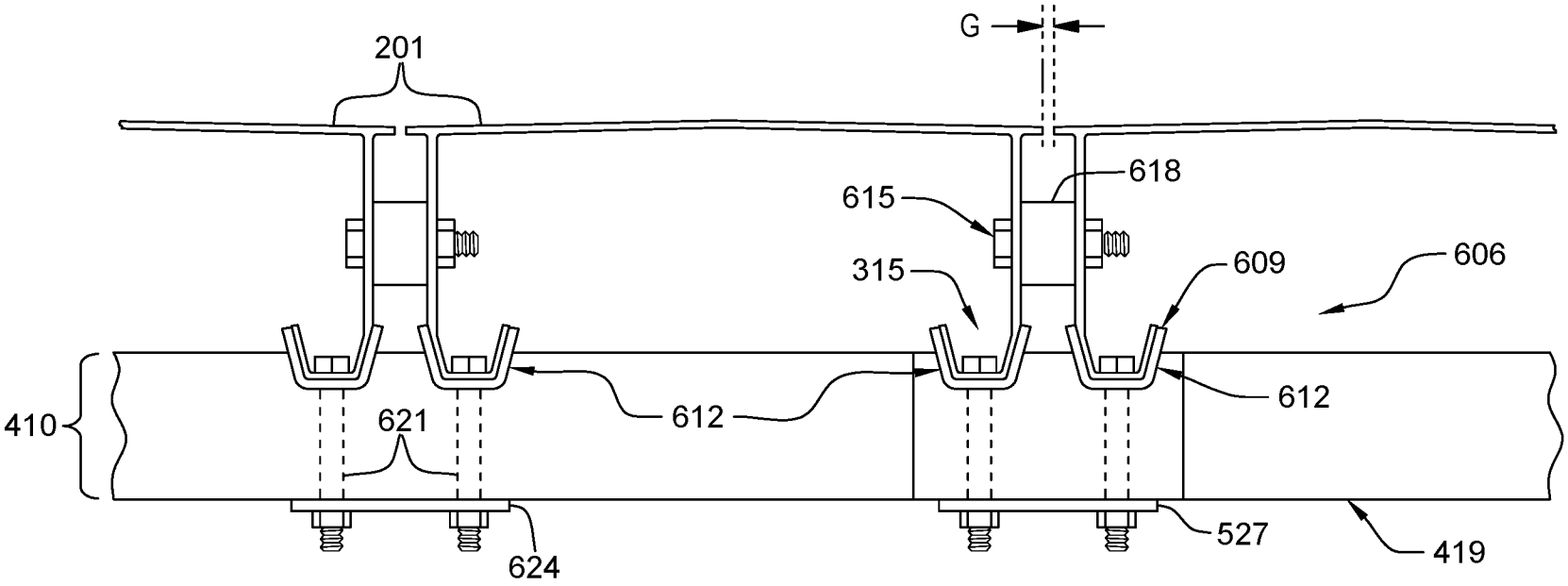
FIG. 6 is a side view of an exemplary deck connection assembly according to structures and methods herein.

Referring to FIG. 6, the deck panels 201 may be attached to the transverse member 410 using a deck connection assembly 606. The deck connection assembly 606 includes receiving shoes 609 that are perpendicular to the transverse member 410. The receiving shoes 609 have a shape corresponding to the foot flange 315 so that the foot flange 315 naturally aligns in the receiving shoe 609. As noted above, the transverse member 410 may comprise an elongated U-channel having a top and a bottom, wherein the top spring plate 527 is attached to the bottom of the elongated U-channel and a plurality of notches 612 are cut in the top of the elongated U-channel. Each notch 612 of the plurality of notches is cut in the transverse member 410 in a predetermined spacing pattern to receive the foot flanges 315 of the integrally formed and vertically disposed legs 306 of the deck panels 201 in order to maintain the gap G between adjacent deck panels 201. Adjacent deck panels 201 may be tied together using a threaded fastener 615 and a spacer block 618 to maintain the gap G and provide rigidity to the deck 100.

The shape of the notches 612 may resemble a parallelogram having an open top in which the angled sides are tapered to create a shaped notch that is sized and configured to hold the receiving shoe 609 having the foot flange 315 therein. Using the deck connection assembly 606, the deck panels 201 may be attached to the transverse member 410 through a hole in the bottom face 318 of the foot flange 315 and the receiving shoe 609 using an appropriate fastener, such as nuts and bolts 621. The receiving shoes 609 are arranged perpendicular to the transverse member 410 and configured to receive the foot flanges 315 of the horizontally disposed deck panels 201. The bottom face 318 of the foot flange 315 rests on the bottom of the receiving shoe 609. The receiving shoe 609 may be installed in the notches 612 and the deck panels 201 attached to the transverse member 410 through the receiving shoe 609 using the nuts and bolts 621. In some embodiments, the receiving shoe 609 may be attached to the deck panel 201 around the foot flange 315 using a plurality of self-drilling sheet metal screws in preselected holes of the receiving shoe 609. For accuracy, the holes may be laser-formed in the receiving shoe 609 and/or the foot flange 315. In some cases, the deck connection assembly 606 may include a cross-tie plate 624 under the transverse member 410 when attaching the deck panels 201 to the transverse member 410.

The terminology used herein is for the purpose of describing particular structures and methods only and is not intended to be limiting of this disclosure. As used herein, the singular forms "a", "an", and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Thus, in one example, "horizontal" is approximately (e.g., within 15%) or somewhat parallel to the surface (e.g., earth surface or ground (ignoring slope), floor, etc.) upon which the structure sits, while "vertical" would be approximately (e.g., within 15%) perpendicular to horizontal. Further, the "bottom" and "top" of structures herein are different locations along the "vertical" direction, with the "bottom" being closer to the surface upon which the structure rests, and the "top" being distal to the surface upon which the structure rests. Also, top and bottom surfaces could lie in horizontal planes and be parallel to one another and be perpendicular to vertical surfaces that run between top and bottom surfaces. Terms such as "contacting", "touching", "on", "in direct contact", "abutting", "directly adjacent to", etc., mean that at least one element physically contacts another element (without other elements separating the described elements). The formation of a first feature "over" or "on" a second feature in the description may include embodiments in which the first and second features are formed in direct contact and may also include embodiments in which additional features may be formed interposing the first and second feature, such that the first and second features may not be in direct contact.

While particular values, relationships, materials, and steps have been set forth for purposes of describing concepts of the structures and methods herein, it will be appreciated by persons skilled in the art that numerous variations and/or modifications may be made to the structures and methods as shown in the disclosure without departing from the spirit or scope of the basic concepts and operating principles of the concepts as broadly described. It should be recognized that, in the light of the above teachings, those skilled in the art could modify those specifics without departing from the concepts taught herein. Having now fully set forth certain structures and methods, and modifications of the concepts underlying them, various other structures and methods, as well as potential variations and modifications of the structures and methods shown and described herein will obviously occur to those skilled in the art upon becoming familiar with such underlying concept. It is intended to include all such modifications and alternatives insofar as they come within the scope of the appended claims or equivalents thereof. It should be understood, therefore, that the concepts disclosed might be practiced otherwise than as specifically set forth herein. Consequently, the present structures and methods are to be considered in all respects as illustrative and not restrictive.

The corresponding structures, materials, acts, and equivalents of all means or step plus function elements in the claims below are intended to include any structure, material, or act for performing the function in combination with other claimed elements as specifically claimed. The descriptions of the various structures and methods herein have been presented for purposes of illustration but are not intended to be exhaustive or limited to the structures and methods disclosed. Many modifications and variations will be apparent to those of ordinary skill in the art without departing from the scope and spirit of the described structures and methods. The terminology used herein was chosen to best explain the principles of the structures and methods, the practical application or technical improvement over technologies found in the marketplace, or to enable others of ordinary skill in the art to understand the structures and methods disclosed herein.

What is claimed is:

1. A structure comprising:

a playing deck comprising a plurality of deck panels;

a support assembly connected to the deck panels; and resilient mounts connecting the deck panels to the support assembly, wherein the resilient mounts are flexible and allow relative motion between the deck panels and the support assembly, wherein the resilient mounts comprise:

a first spring capture assembly attached to the support assembly, a second spring capture assembly attached to the playing deck, and a plurality of springs disposed between the first spring capture assembly and the second spring capture assembly, wherein each of the first spring capture assembly and second spring capture assembly comprises a spring plate; and retention plates comprising multiple pieces that capture the outside of each spring of the plurality of springs.

2. The structure according to claim 1, wherein the retention plates comprise High Density Poly Ethylene (HDPE).

3. The structure according to claim 1, wherein the retention plates are attached to the spring plate.

4. The structure according to claim 1, wherein each deck panel of the plurality of deck panels comprises:

a top plate; and legs integrally formed with the top plate, the legs being substantially perpendicular to the top plate wherein the legs have a top adjacent to the top plate and a bottom remote from the top plate, wherein the legs further comprise a foot flange at the bottom of each leg, wherein the structure further comprises a transverse member in which the foot flange is mounted, wherein the transverse member is attached to the resilient mounts, wherein the transverse member comprises a plurality of notches, and wherein each notch of the plurality of notches is in a spacing pattern along the span of the transverse member and connects to the foot flange.

5. The structure according to claim 1, wherein the support assembly further comprises:

a plurality of piers configured to be anchored in the ground; and

I-beams on the piers, wherein each deck panel of the plurality of deck panels spans multiple adjacent parallel I-beams.

6. The structure according to claim 5, further comprising a transverse member attached to the plurality of deck panels, wherein the transverse member comprises a plurality of notches, wherein the deck panels comprise foot flanges, and wherein the plurality of notches are in a spacing pattern along the span of the transverse member and connect to the foot flanges of the deck panels.

7. A resilient platform assembly comprising:

a playing deck comprising a plurality of horizontally disposed deck panels, wherein each deck panel of the plurality of horizontally disposed deck panels comprises a pair of foot flanges;

receiving shoes attached to the foot flanges of the deck panels;

a transverse member attached to the deck panels through the receiving shoes, wherein the transverse member is perpendicular to the plurality of horizontally disposed deck panels, wherein the transverse member comprises a plurality of notches, wherein each notch of the plurality of notches is in a spacing pattern along the span of the transverse member, and wherein the receiving shoes are in the notches;

resilient mounts connected to the transverse member; and a support assembly connected to the resilient mounts, wherein the resilient mounts comprise:

a first spring capture assembly attached to the support assembly, a second spring capture assembly attached to the transverse, and a plurality of springs disposed between the first spring capture assembly and the second spring capture assembly.

8. The resilient platform assembly according to claim 7, wherein each of the first spring capture assembly and second spring capture assembly comprises:

a spring plate; and retention plates comprising multiple pieces that capture the outside of each spring of the plurality of springs.

9. The resilient platform assembly according to claim 8, wherein the retention plates comprise High Density Poly Ethylene (HDPE).

10. The resilient platform assembly according to claim 8, wherein the retention plates are attached to the spring plate.

11. The resilient platform assembly according to claim 7, wherein each deck panel of the plurality of horizontally disposed deck panels comprises:

a top plate; and legs integrally formed with the top plate, the legs being substantially perpendicular to the top plate wherein the legs have a top adjacent to the top plate and a bottom remote from the top plate, wherein the legs are attached to the foot flanges at the bottom of each leg, wherein the receiving shoes are between the foot flanges and the transverse member, and wherein the foot flanges are bolted to the transverse member through the receiving shoes.

12. The resilient platform assembly according to claim 7, wherein the support assembly further comprises:

a plurality of piers configured to be anchored in the ground; and

I-beams on the piers, wherein each deck panel of the plurality of horizontally disposed deck panels spans multiple adjacent parallel I-beams.

13. A platform assembly comprising:

a supporting substructure comprising:

a plurality of piers configured to be anchored in the ground, and a plurality of I-beams on the piers, wherein each of the I-beams has a top surface at a predefined distance above the ground;

transverse members arranged in a spaced apart layout parallel to the I-beams, wherein the transverse members have a bottom surface above the top surface of the I-beams relative to the ground, wherein the transverse members comprise a plurality of notches in the transverse members, and wherein each notch of the plurality of notches is in a spacing pattern along the span of the transverse members; and a mounting assembly resiliently connecting the supporting substructure and the transverse members, wherein the mounting assembly comprises:

a first spring capture assembly attached to the supporting substructure, a second spring capture assembly attached to the transverse members, and a plurality of springs disposed between the first spring capture assembly and the second spring capture assembly.

14. The platform assembly according to claim 13, wherein each of the first spring capture assembly and second spring capture assembly comprises:

a spring plate; and retention plates comprising multiple pieces that capture the outside of each spring of the plurality of springs.

15. The platform assembly according to claim 14, wherein the retention plates comprise High Density Poly Ethylene (HDPE).

16. The platform assembly according to claim 14, wherein the retention plates are attached to the spring plate.

17. The platform assembly according to claim 13, further comprising:

a plurality of horizontally disposed deck panels attached to the transverse members.

18. The platform assembly according to claim 17, wherein each deck panel of the plurality of horizontally disposed deck panels comprises:

a top plate; and legs integrally formed with the top plate, wherein the legs are substantially perpendicular to the top plate, wherein the legs have a top adjacent to the top plate and a bottom remote from the top plate, wherein the legs further comprise a foot flange at the bottom of each leg, wherein the foot flange is mounted in the transverse members, and wherein each notch of the plurality of notches is in a spacing pattern along the span of the transverse members and connects to the foot flange.

19. The platform assembly according to claim 18, further comprising:

a receiving shoe located between the foot flange and the transverse members in each of the notches, wherein the receiving shoe is perpendicular to the transverse members, wherein the foot flange is bolted to the transverse member through the receiving shoe.

* * * * *